US011847991B2

(12) United States Patent
Liang et al.

(10) Patent No.: US 11,847,991 B2
(45) Date of Patent: Dec. 19, 2023

(54) VOLTAGE SUPPLY CIRCUIT, DISPLAY DRIVER CIRCUIT, DISPLAY DEVICE, AND DISPLAY DRIVING METHOD

(71) Applicants: Hefei BOE Display Technology Co., Ltd., Anhui (CN); BOE TECHNOLOGY GROUP CO., LTD., Beijing (CN)

(72) Inventors: Yunyun Liang, Beijing (CN); Liugang Zhou, Beijing (CN); Ke Dai, Beijing (CN); Liu He, Beijing (CN); Jianwei Sun, Beijing (CN); Jun Wang, Beijing (CN); Qing Li, Beijing (CN); Yu Quan, Beijing (CN)

(73) Assignees: Hefei BOE Display Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/778,125

(22) PCT Filed: May 11, 2021

(86) PCT No.: PCT/CN2021/093003

§ 371 (c)(1),
(2) Date: May 19, 2022

(87) PCT Pub. No.: WO2021/238643

PCT Pub. Date: Dec. 2, 2021

(65) Prior Publication Data

US 2022/0415280 A1 Dec. 29, 2022

(30) Foreign Application Priority Data

May 29, 2020 (CN) ..... 202010477402.6

(51) Int. Cl.
*G09G 3/36* (2006.01)

(52) U.S. Cl.
CPC ..... *G09G 3/3696* (2013.01); *G09G 3/3614* (2013.01); *G09G 2310/08* (2013.01);
(Continued)

(58) Field of Classification Search
CPC ..... G06F 1/3287; G06F 1/06; G06F 1/26
See application file for complete search history.

(56) References Cited

U.S. PATENT DOCUMENTS 7,863,971 B1 * 1/2011 Nayak ..... H03K 19/0016 327/543
2015/0280703 A1 * 10/2015 Jeon ..... H03K 17/6871 327/382

(Continued)

FOREIGN PATENT DOCUMENTS

CN 101515440 A 8/2009
CN 105096857 A 11/2015

(Continued)

OTHER PUBLICATIONS

Chen Chaoyong; Li Huafeng CN207234673 Apr. 13, 2018 (Year: 2018).*

(Continued)

*Primary Examiner* — Van N Chow
(74) *Attorney, Agent, or Firm* — HOUTTEMAN LAW LLC

(57) ABSTRACT

There is provided a voltage supply circuit, in which a signal output end of a power management integrated circuit, a signal input end of a transmission branch, and a signal input end of a voltage reduction branch are coupled to a first node; a signal output end of transmission branch and a signal output end of the voltage reduction branch are coupled to a second node; the power management integrated circuit supplies an initial voltage to the first node; the transmission branch is coupled to a control signal terminal, and switch
(Continued)

between a conducting state and a cutoff state in response to control of a control signal, and write the initial voltage into the second node in the conducting state; and the voltage reduction branch performs voltage reduction on the initial voltage at the first node to obtain a reduced voltage to be written into the second node.

20 Claims, 5 Drawing Sheets

(52) U.S. Cl.
CPC ..... *G09G 2320/0247* (2013.01); *G09G 2330/021* (2013.01)

(56) References Cited

U.S. PATENT DOCUMENTS

| | | | | |
|---|---|---|---|---|
| 2019/0101951 | A1* | 4/2019 | Sather | H01M 10/0585 |
| 2022/0029444 | A1* | 1/2022 | Chen | H02J 7/0029 |

FOREIGN PATENT DOCUMENTS

| | | | |
|---|---|---|---|
| CN | 206657359 | U | 11/2017 |
| CN | 207234673 | U | 4/2018 |
| CN | 208174537 | U | 11/2018 |
| CN | 110097857 | A | 8/2019 |
| CN | 210183218 | U | 3/2020 |
| CN | 111508449 | A | 8/2020 |
| KR | 20190057747 | A | 5/2019 |
| TW | 201340065 | A | 10/2013 |

OTHER PUBLICATIONS

China Patent Office, CN202010477402.6 First Office Action dated Jul. 5, 2021.

* cited by examiner

VOLTAGE SUPPLY CIRCUIT, DISPLAY DRIVER CIRCUIT, DISPLAY DEVICE, AND DISPLAY DRIVING METHOD

This application claims priority from Chinese patent application No. 202010477402.6 filed on May 29, 2020, the entirety of which is incorporated herein by reference.

TECHNICAL FIELD

The present disclosure relates to the field of display technology, and in particular relates to a voltage supply circuit, a display driver circuit, a display device, and a display driving method.

BACKGROUND

In order to prevent polarization of liquid crystal molecules in a liquid crystal display device, the liquid crystal display device is generally driven in a column inversion or frame inversion mode; and in order to avoid a residual image caused by a relatively large bias voltage accumulated in pixel cells due to a long-time single polarity change rule, the polarity change rule, i.e., the polarity inversion, is typically adjusted periodically.

During adjusting the polarity inversion, each inversion adjustment cycle for adjusting the polarity inversion includes an even number of frames, and in each inversion adjustment cycle, polarities of signals of a same pixel cell in adjacent frames are opposite to each other (for example, in a column inversion or frame inversion mode), while in adjacent inversion adjustment cycles, the signal of any pixel cell in a last frame in a previous inversion adjustment cycle has the same polarity with the signal of the pixel cell in a first frame in a next inversion adjustment cycle. In two adjacent inversion adjustment cycles, one inversion adjustment cycle may cause positive bias voltage to be accumulated in the pixel cell, while the other inversion adjustment cycle may cause negative bias voltage to be accumulated in the pixel cell, and the positive bias voltage and the negative bias voltage may be mutually offset.

However, since the signal of any pixel cell in the last frame in the previous inversion adjustment cycle has the same polarity with the signal of the pixel cell in the first frame in the next inversion adjustment cycle, (i.e. no polarity inversion is performed), liquid crystal molecules in the pixel cell are deflected in a same direction, and have a larger deflection angle in the first frame of the next inversion adjustment cycle, which means that the pixel cell is brighter in the first frame of the next inversion adjustment cycle. From a perspective of the whole display screen, brightness in the previous frame and brightness in the next frame present are different in a static image, causing flicker of the image and influencing the image quality.

SUMMARY

In a first aspect, an embodiment of the present disclosure provides a voltage supply circuit, including: a power management integrated circuit, a transmission branch, and a voltage reduction branch, a signal output end of the power management integrated circuit, a signal input end of the transmission branch, and a signal input end of the voltage reduction branch are coupled to a first node; a signal output end of the transmission branch and a signal output end of the voltage reduction branch are coupled to a second node;

the power management integrated circuit is configured to supply an initial voltage to the first node;

the transmission branch is coupled to a control signal terminal, has a conducting state and a cutoff state, and is configured to switch between the conducting state and the cutoff state in response to control of a control signal provided by the control signal terminal, and write the initial voltage at the first node into the second node in the conducting state; and the voltage reduction branch is configured to perform voltage reduction on the initial voltage at the first node to obtain a reduced voltage, and write the reduced voltage into the second node when the transmission branch is in the cutoff state.

In some implementations, the voltage supply circuit further includes: a state control circuit having a signal output end coupled to the control signal terminal;

the state control circuit is configured to provide a first control signal lasting for a preset time length to the control signal terminal every other preset cycle, and provide a second control signal to the control signal terminal after the preset time length expires; and the transmission branch is switched to the cutoff state in response to control of the first control signal, and switched to the conducting state in response to control of the second control signal.

In some implementations, the state control circuit includes a timer, a digital-to-analog conversion circuit, and a switch controller, the timer is coupled to a signal input end of the digital-to-analog conversion circuit, a signal output end of the digital-to-analog conversion circuit is coupled to a signal input end of the switch controller, and a signal output end of the switch controller is coupled to the control signal terminal;

the timer is configured to time at a start of each preset cycle, send a timing result as a digital signal to the digital-to-analog conversion circuit and reset the timing result at an end of each preset cycle;

the digital-to-analog conversion circuit is configured to perform digital-to-analog conversion on the received digital signal based on a preset digital-to-analog conversion rule to obtain a corresponding analog signal, and send the analog signal to the switch controller; and the switch controller is configured to output the first control signal or the second control signal matched with the analog signal in response to control of the analog signal.

In some implementations, the switch controller includes: a first resistor, a second resistor and a first transistor;

a first end of the first resistor is coupled to the first node, and a second end of the first resistor is coupled to a first end of the second resistor;

the first end of the second resistor is coupled to a signal output end of the switch controller, and a second end of the second resistor is coupled to a first electrode of the first transistor; and a control electrode of the first transistor is coupled to a signal input end of the switch controller, and a second electrode of the first transistor is coupled to a first power supply terminal.

In some implementations, the transmission branch includes: a second transistor and a first diode;

a control electrode of the second transistor is coupled to the control signal terminal, a first electrode of the second transistor is coupled to the first node, a second electrode of the second transistor is coupled to a first end of the first diode, and a second end of the first diode is coupled to the second node.

In some implementations, the voltage reduction branch includes: a low dropout regulator and a second diode;

a signal input end of the low dropout regulator is coupled to the signal input end of the voltage reduction branch, and a signal output end of the low dropout regulator is coupled to a first end of the second diode; and a second end of the second diode is coupled to the signal output end of the voltage reduction branch.

In some implementations, the low dropout regulator includes: a low dropout regulator chip, and a peripheral circuit including a first slide rheostat, a third resistor, a third diode, a fourth diode and a first capacitor;

a control end of the first slide rheostat is coupled to a second power supply terminal, a first end of the first slide rheostat is coupled to an output voltage adjusting end of the low dropout regulator chip, and a second end of the first slide rheostat is floating;

a first end of the third resistor is coupled to the output voltage adjusting end of the low dropout regulator chip, and a second end of the third resistor is coupled to a signal output end of the low dropout regulator chip;

a first end of the third diode is coupled to the output voltage adjusting end of the low dropout regulator chip, and a second end of the third diode is coupled to the signal output end of the low dropout regulator chip;

a first end of the fourth diode is coupled to the signal output end of the low dropout regulator chip, and a first end of the fourth diode is coupled to a signal input end of the low dropout regulator chip; and a first end of the first capacitor is coupled to the signal output end of the low dropout regulator chip, and a second end of the first capacitor is coupled to the second power supply terminal.

In some implementations, the voltage reduction branch includes a third transistor, a second slide rheostat, a third slide rheostat and a second diode;

a control electrode of the third transistor is coupled to a control end of the second slide rheostat and a first end of the third slide rheostat, a first electrode of the third transistors is coupled to the signal input end of the voltage reduction branch, and a second electrode of the third transistor is coupled to a first end of the second diode;

a second end of the second diode is coupled to the signal output end of the voltage reduction branch;

a first end of the second slide rheostat is coupled to the signal input end of the voltage reduction branch, and a second end of the second slide rheostat is floating;

a control end of the third slide rheostat is coupled to a second power supply terminal, and a second end of the third slide rheostat is floating; and the second end of the second diode is coupled to the signal output end of the voltage reduction branch.

In some implementations, the voltage reduction branch includes a fourth resistor, a fifth resistor, a Zener diode, a fourth slide rheostat, a second capacitor and a second diode;

a first end of the fourth resistor is coupled to the signal input end of the voltage reduction branch, and a second end of the fourth resistor is coupled to a first end of the second diode;

a first end of the fifth resistor is coupled to the first end of the second diode, and a second end of the fifth resistor is coupled to a first end of the fourth slide rheostat;

a control end of the fourth slide rheostat is coupled to a second power supply terminal, the first end of the fourth slide rheostat is coupled to a reference signal supply end of the Zener diode, and a second end of the fourth slide rheostat is floating;

a first electrode of the Zener diode is coupled to the second power supply terminal, and a second electrode of the Zener diode is coupled to the first end of the second diode;

a first end of the second capacitor is coupled to the second electrode of the Zener diode, and a second end of the second capacitor is coupled to the reference signal supply end of the Zener diode; and a second end of the second diode is coupled to the signal output end of the voltage reduction branch.

In some implementations, the voltage supply circuit further includes a level conversion circuit, the level conversion circuit has a signal input end coupled to the second node, and is configured to perform level conversion on a signal at the second node.

In a second aspect, an embodiment of the present disclosure further provides a display driver circuit, including a gate driver circuit, and the voltage supply circuit as described in the first aspect above, a signal output end of the voltage supply circuit is coupled to an operating voltage input end configured for the gate driver circuit.

In a third aspect, an embodiment of the present disclosure further provides a display device, including the display driver circuit as described in the second aspect above.

In a fourth aspect, an embodiment of the present disclosure further provides a display driving method based on the display driver circuit according to the second aspect, the display driving method including:

providing, by the voltage supply circuit, a first operating voltage to the operating voltage input end configured for the gate driver circuit in a first frame in an inversion adjustment cycle; and providing, by the voltage supply circuit, a second operating voltage to the operating voltage input end configured for the gate driver circuit in another frame except the first frame in the inversion adjustment cycle, the first operating voltage is lower than the second operating voltage.

DETAIL DESCRIPTION OF EMBODIMENTS

To improve understanding of the technical solution of the present disclosure for those skilled in the art, the voltage supply circuit, the display driver circuit, the display device, and the display driving method provided in the present disclosure will be described below in detail in conjunction with the accompanying drawings.

The transistors involved in the embodiment of the present disclosure may be independently selected from a polysilicon thin film transistor, an amorphous silicon thin film transistor, an oxide thin film transistor, or an organic thin film transistor. Reference in the present disclosure to "control electrode" means a gate of a transistor, "first electrode" means a source of a transistor, and accordingly, "second electrode" means a drain of a transistor. Apparently, it should be known by those skilled in the art that the "first electrode" and the "second electrode" are interchangeable.

In addition, transistors may be divided into N-type transistors and P-type transistors, and each transistor in the present disclosure may be independently selected from an N-type transistor or a P-type transistor.

Figure 1:
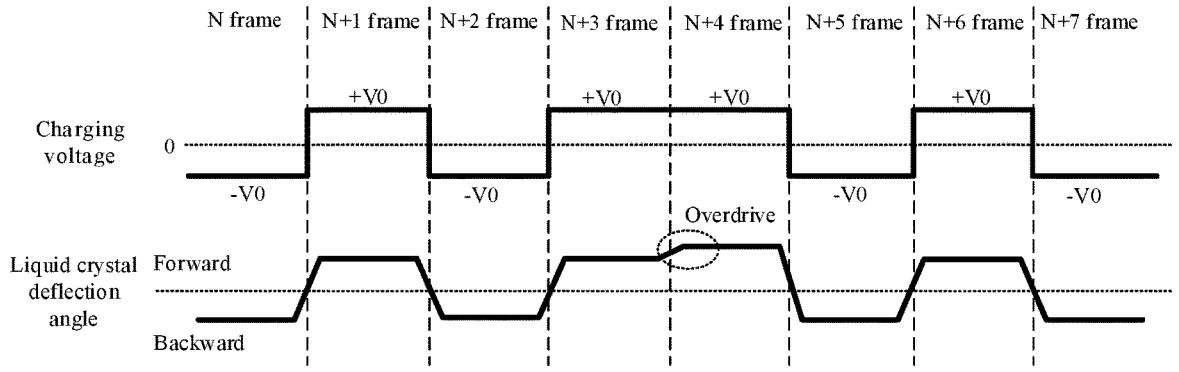
FIG. 1 is a schematic diagram illustrating polarities of charging voltages and deflection angles of liquid crystal in polarity inversion of a pixel cell in a display device in the existing art.

FIG. 1 is a schematic diagram illustrating polarities of charging voltages and deflection angles of liquid crystal in polarity inversion of a pixel cell in a display device in the existing art. As shown in FIG. 1, FIG. 1 schematically illustrates conditions of a pixel cell in last 4 frames (frames N to N+3 in the figure) of a previous inversion adjustment cycle and first 4 frames (frames N+4 to N+7 in the figure) of a next inversion adjustment cycle in a static image.

In the last 4 frames (i.e., frames N to N+3 in the figure) of the previous inversion adjustment cycle, charging voltages applied to the pixel cell are −V0, +V0, −V0 and +V0, and polarities of the charging voltages are negative (−), positive (+), negative (−) and positive (+). In the first 4 frames (i.e., frames N+4 to N+7 in the figure) of the next inversion adjustment cycle, charging voltages applied to the pixel cell are +V0, −V0, +V0 and −V0, and polarities of the charging voltages are positive (+), negative (−), positive (+) and negative (−).

The charging voltage applied to the pixel cell in a first frame (i.e., frame N+4 in the figure) of the next inversion adjustment cycle has the same polarity as the charging voltage applied to the pixel cell in a last frame (i.e., frame N+3 frame in the figure) of the previous inversion adjustment cycle. For a same charging voltage +V0, a deflection angle of liquid crystal molecules corresponding to the pixel cell in frame N+4 is greater than that in frame N+3 (which is referred to as "overdrive effect"), which means that brightness of the pixel cell in frame N+4 is greater than that in frame N+3.

To solve the above problem in the existing art, a technical solution of the present disclosure provides a voltage supply circuit, a display driver circuit, a display device, and a display driving method.

Figure 2:
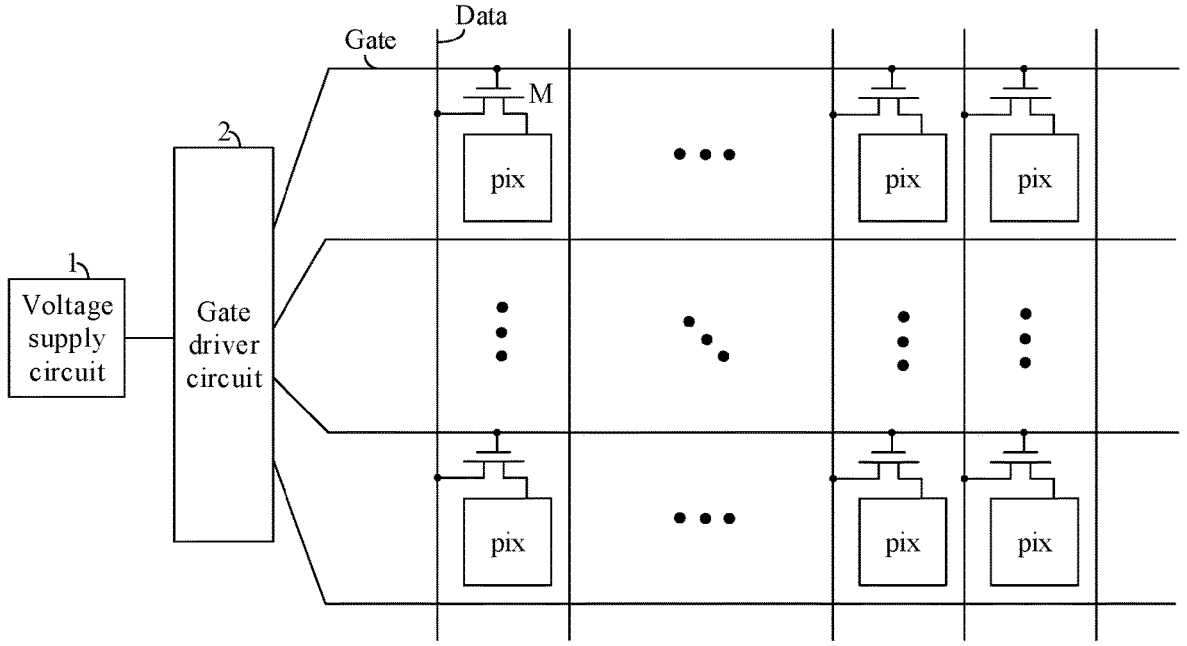
FIG. 2 is a schematic structural diagram of a display device according to an embodiment of the present disclosure.

FIG. 2 is a schematic structural diagram of a display device according to an embodiment of the present disclosure. As shown in FIG. 2, the display device includes a liquid crystal display panel and a display driver circuit. The display driver circuit include: a voltage supply circuit 1 and a gate driver circuit 2. In some implementations, the gate driver circuit 2 is formed on an array substrate of the liquid crystal display panel by an array process, called gate driver on array (GOA), and a signal output end of the voltage supply circuit 1 is coupled to an operating voltage input end configured for the gate driver circuit 2.

In a display driving process, the voltage supply circuit 1 may provide an operating voltage to the operating voltage input end of the gate driver circuit 2, and the operating voltage input end transfers the received operating voltage to respective stages of shift registers in the gate driver circuit 2 so that the respective stages of shift registers in the gate driver circuit 2 can sequentially output scanning signals, and a voltage of each of the scanning signals in an active level state is equal to the operating voltage provided from the operating voltage input end.

When a scanning signal is loaded onto a gate line Gate of the display panel, and when the scanning signal is in an active level state, a switch transistor M in a pixel cell electrically coupled to the gate line Gate is in a conducting state, i.e., turned on, and a data voltage (charging voltage) in a data line Data is written into the corresponding pixel cell through the switch transistor M in the conducting state/being turned on, so as to drive the pixel cell.

It should be noted that, in the present disclosure, the term "active level" is defined with respect to a type of the switch transistor M; if the switch transistor M is an N-type transistor, the "active level" refers to a higher level; and if the switch transistor M is a P-type transistor, the "active level" refers to a lower level. In the embodiment of the present disclosure, exemplary explanation is given taking a case where the switch transistor M is an N-type transistor and the active level is a higher level as an example.

Figure 3:
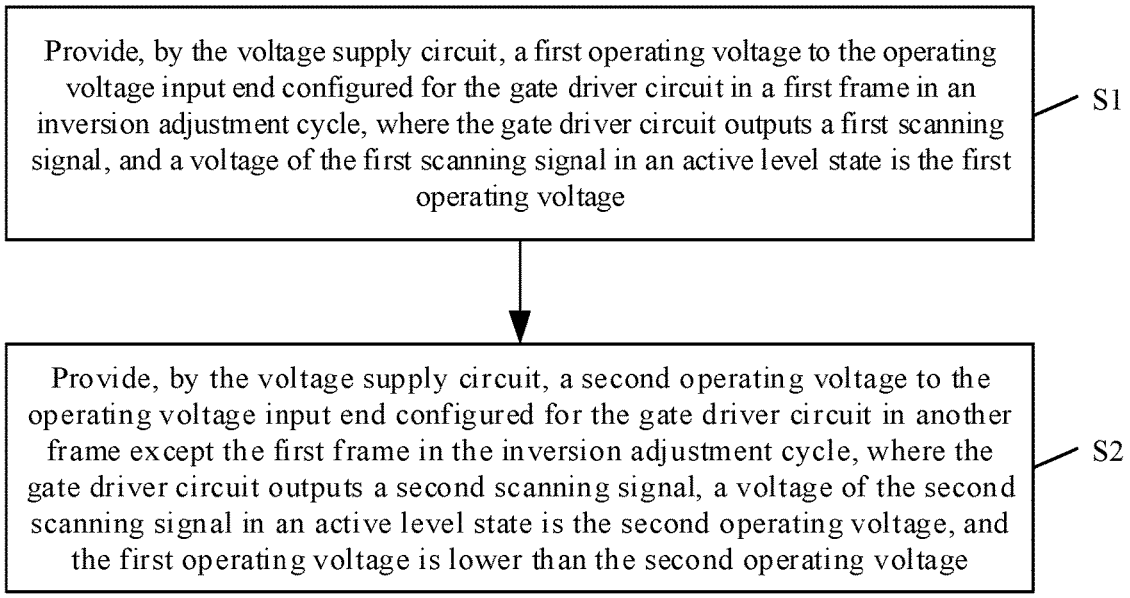
FIG. 3 is a flowchart of a display driving method according to an embodiment of the present disclosure.

FIG. 3 is a flowchart of a display driving method according to an embodiment of the present disclosure. As shown in FIG. 3, the display driving method includes the following steps S1 to S2.

At step S1, providing, by the voltage supply circuit, a first operating voltage to the operating voltage input end configured for the gate driver circuit in a first frame in an inversion adjustment cycle, where the gate driver circuit outputs a first scanning signal, and a voltage of the first scanning signal in an active level state is the first operating voltage.

At step S2, providing, by the voltage supply circuit, a second operating voltage to the operating voltage input end configured for the gate driver circuit in another frame except the first frame in the inversion adjustment cycle, where the gate driver circuit outputs a second scanning signal, a voltage of the second scanning signal in an active level state is the second operating voltage, and the first operating voltage is lower than the second operating voltage.

In practical applications, the above steps S1 and S2 are alternately performed.

Figure 4:
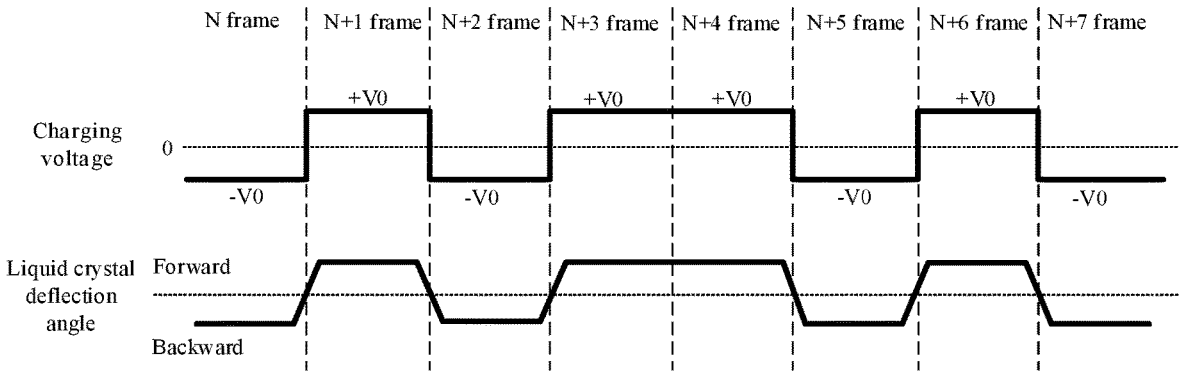
FIG. 4 is a schematic diagram illustrating polarities of charging voltages and deflection angles of liquid crystal in polarity inversion of a pixel cell in a display device according to an embodiment of the present disclosure.

FIG. 4 is a schematic diagram illustrating polarities of charging voltages and deflection angles of liquid crystal in polarity inversion of a pixel cell in a display device according to an embodiment of the present disclosure. As shown in FIG. 4, FIG. 4 schematically illustrates conditions of a pixel cell in last 4 frames (frames N to N+3 in the figure) of a previous inversion adjustment cycle and first 4 frames (frames N+4 to N+7 in the figure) of a next inversion adjustment cycle in an embodiment of the present disclosure.

The charging voltage applied to the pixel cell in a first frame (i.e., frame N+4 in the figure) of the next inversion adjustment cycle is the same as the charging voltage applied to the pixel cell in a last frame (i.e., frame N+3 frame in the figure) of the previous inversion adjustment cycle, i.e., each of them is +V0.

For convenience of description, the first operating voltage is denoted as V1, the second operating voltage is denoted as V2, and V1<V2.

In the embodiment of the present disclosure, in the last frame (frame N+3 in the figure) of the previous inversion adjustment cycle, a data voltage of a gate line Gate to which a switch transistor M in the pixel cell is coupled is V2, a voltage of a data line Data to which the switch transistor M in the pixel cell is coupled is +V0, and a gate-source voltage of the switch transistor M is V2−V0.

In the first frame (frame N+4 in the figure) of the next inversion adjustment cycle, a voltage of the gate line Gate to which the switch transistor M in the pixel cell is coupled is V1, a data voltage of the data line Data to which the switch transistor M in the pixel cell is coupled is +V0, and a gate-source voltage of the switch transistor M is V1−V0, where V1−V0<V2−V0.

Since a magnitude of the gate-source voltage determines a degree of conduction of the switch transistor M (the greater the gate-source voltage is, the higher the degree of conduction of the switch transistor M is), the degree of conduction of the switch transistor M in frame N+4 is lower than that in frame N+3. Therefore, an actual voltage applied to a pixel electrode pix of the pixel cell in frame N+4 is lower than the voltage applied in frame N+3, and a liquid crystal electric field formed by the pixel cell in frame N+4 is smaller than that formed in frame N+3. Due to the fact that the liquid crystal electric field is reduced, the deflection angle of liquid crystal molecules can be reduced, and thus, the overdrive effect caused by the fact that polarity inversion is not performed can be compensated for.

An amount of compensation is determined by a voltage difference between V2 and V1. In practical applications, magnitudes of V2 and V1 may be set according to preliminary experiments to ensure that the pixel cells exhibit same display brightness in the first frame of the next inversion adjustment cycle and the last frame of the previous inversion adjustment cycle when a same data voltage is applied.

As can be seen from the above, the technical solution of the present disclosure can effectively solve the problem of flicker caused by the overdrive effect during adjusting the polarity inversion.

In the existing art, the voltage supply circuit 1 can only provide a fixed operating voltage to the gate driver circuit 2, but cannot meet the requirement of providing the "first operating voltage" and the "second operating voltage" respectively at different time points in the embodiment of the present disclosure. In view of this, an embodiment of the present disclosure further provides a voltage supply circuit 1.

Figure 5:
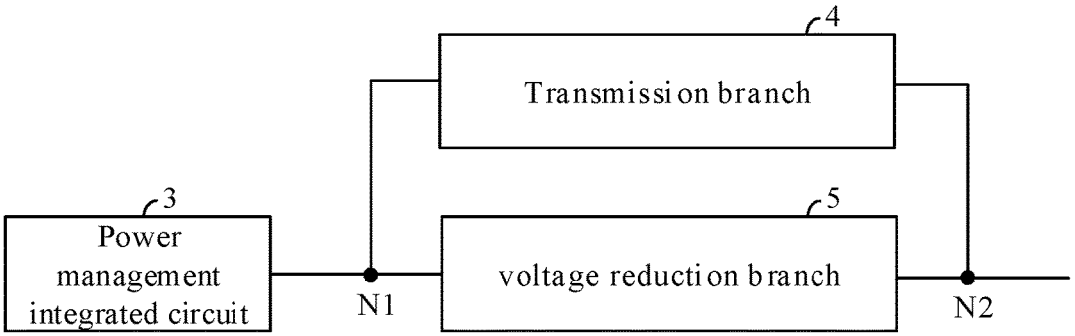
FIG. 5 is a schematic circuit diagram of a voltage supply circuit according to an embodiment of the present disclosure.

FIG. 5 is a schematic circuit diagram of a voltage supply circuit according to an embodiment of the present disclosure. As shown in FIG. 5, the voltage supply circuit 1 may be used to implement steps of the display driving method described above, and includes a power management integrated circuit 3, a transmission branch 4, and a voltage reduction branch 5. A signal output end of the power management integrated circuit 3, a signal input end of the transmission branch 4, and a signal input end of the voltage reduction branch 5 are coupled to a first node N1, and a signal output end of the transmission branch 4 and a signal output end of the voltage reduction branch 5 are coupled to a second node N2.

The power management integrated circuit (PMIC) 3 is configured to provide an initial voltage to the first node N1.

The transmission branch 4 is coupled to a control signal terminal, has a conducting state and a cutoff state, and is configured to switch between the conducting state and the cutoff state in response to control of a control signal provided by the control signal terminal, and write the initial voltage at the first node N1 into the second node N2 in the conducting state.

The voltage reduction branch 5 is configured to perform voltage reduction on the initial voltage at the first node N1 to obtain a reduced voltage, and write the reduced voltage into the second node N2 when the transmission branch 4 is in the cutoff state. The reduced voltage is lower than the initial voltage.

In practical applications, a voltage difference between the initial voltage and the reduced voltage may be controlled by configuring the voltage reduction branch in advance (for example, during factory debugging of a product).

In some implementations, the initial voltage may be the second operating voltage, and the reduced voltage may be the first operating voltage. That is, different operating voltages may be respectively supplied to the gate driver circuit 2 through the transmission branch 4 and the voltage reduction branch 5.

Figure 6:
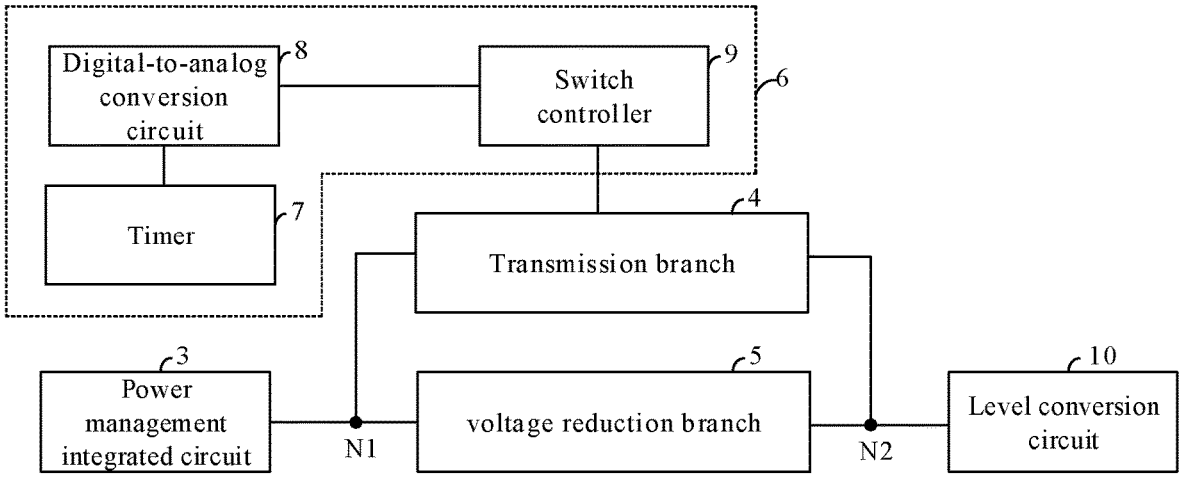
FIG. 6 is another schematic circuit diagram of a voltage supply circuit according to an embodiment of the present disclosure.

FIG. 6 is another schematic circuit diagram of a voltage supply circuit according to an embodiment of the present disclosure. As shown in FIG. 6, the voltage supply circuit 1 shown in FIG. 6 includes not only the power management integrated circuit 3, the transmission branch 4, and the voltage reduction branch 5 shown in FIG. 5, but also a state control circuit 6. A signal output end of the state control circuit 6 is coupled to the control signal terminal, and the state control circuit 6 is configured to provide a first control signal lasting for a preset time length to the control signal terminal every other preset cycle, and provide a second control signal to the control signal terminal after the preset time length expires.

The transmission branch 4 is switched to the cutoff state in response to control of the first control signal, and switched to the conducting state in response to control of the second control signal.

In the embodiment of the present disclosure, by configuring the state control circuit 6, the time points at which the transmission branch 4 is switched to the conducting state and to the cutoff state can be automatically controlled.

In practical applications, a duration of the preset cycle is configured to be a duration of one inversion adjustment cycle (for example, 28 s), and the preset time length is configured to be a duration of a first frame in the inversion adjustment cycle. In this manner, it is achieved that the voltage supply circuit 1 automatically supplies the first operating voltage to the gate driver circuit 2 in the first frame of the inversion adjustment cycle, and automatically supplies the second operating voltage to the gate driver circuit 2 in other frames of the inversion adjustment cycle.

In some implementations, the state control circuit 6 includes a timer 7, a digital-to-analog conversion circuit 8, and a switch controller 9. The timer 7 is coupled to a signal input end of the digital-to-analog conversion circuit 8, a signal output end of the digital-to-analog conversion circuit 8 is coupled to a signal input end of the switch controller 9, and a signal output end of the switch controller 9 is coupled to the control signal terminal.

Illustratively, the timer 7 is configured to time at a start of each preset cycle, send a timing result as a digital signal to the digital-to-analog conversion circuit 8, and reset the timing result at an end of each preset cycle. As an example, the timer 7 may include a timer control integrated circuit and a counter. The timer control integrated circuit may be configured to generate timer pulses, and the counter may be configured to count the timer pulses generated by the timer control integrated circuit to achieve the purpose of timing.

The digital-to-analog conversion circuit 8 is configured to perform digital-to-analog conversion on the received digital signal based on a preset digital-to-analog conversion rule to obtain a corresponding analog signal, and send the analog signal to the switch controller 9.

The switch controller 9 is configured to output the first control signal or the second control signal matched with the analog signal in response to control of the analog signal.

For ease of understanding, the following detailed description will be given with reference to specific examples. Assuming that a duration of an inversion adjustment cycle is 28 s, an operating frequency of the display device is 60 HZ, each inversion adjustment cycle includes 28×60=1680 frames, each frame lasts for 1/60 s, and a reset threshold configured for the counter is 1680, then the timer control integrated circuit may be controlled to output a timer pulse every 1/60 s.

When a first frame in an inversion adjustment cycle starts, the timer control integrated circuit may be controlled to synchronously output a first timer pulse, and the counter counts 1; and when the first frame is ended and a second frame starts, the timer control integrated circuit synchronously outputs a second timer pulse, and the counter counts 2, . . . , so on and so forth, until a 1679-th frame is ended and a 1680-th frame starts, and the counter counts 1680, where the counting result reaches the reset threshold, and the counter is reset. When a next inversion adjustment cycle starts, the counter restarts counting.

The digital-to-analog conversion circuit 8 is configured to output an analog signal "1" when the count result is 1, and output an analog signal "0" when the count result is not 1 (exemplarily, "1" represents a high-level signal, and "0" represents a low-level signal). The switch controller 9 is configured to output a first control signal when receiving the analog signal "1", to control the transmission branch 4 in the cutoff state, and output a second control signal when receiving the analog signal "0", to control the transmission branch 4 in the conducting state.

Figure 7:
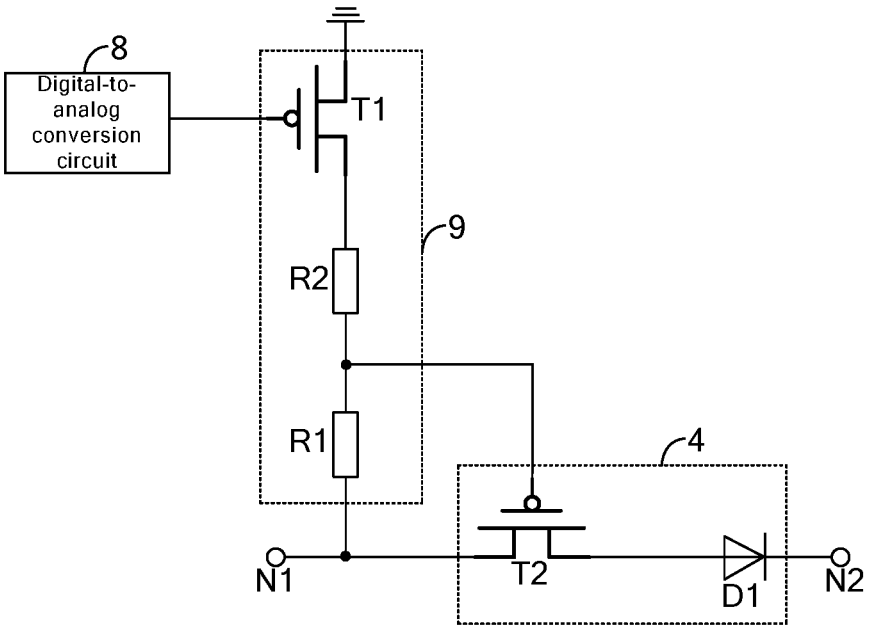
FIG. 7 is a schematic circuit diagram of a switch controller and a transmission branch according to an embodiment of the present disclosure.

FIG. 7 is a schematic circuit diagram of a switch controller and a transmission branch according to an embodiment of the present disclosure. As shown in FIG. 7, the switch controller 9 includes a first resistor R1, a second resistor R2 and a first transistor T1. A first end of the first resistor R1 is coupled to the first node N1, and a second end of the first resistor R1 is coupled to a first end of the second resistor R2; the first end of the second resistor R2 is coupled to a signal output end of the switch controller 9, and a second end of the second resistor R2 is coupled to a first electrode of the first transistor T1; and a control electrode of the first transistor T1 is coupled to a signal input end of the switch controller 9, and a second electrode of the first transistor T1 is coupled to a first power supply terminal.

In some implementations, the transmission branch 4 includes a second transistor T2 and a first diode D1. A control electrode of the second transistor T2 is coupled to the control signal terminal, a first electrode of the second transistor T2 is coupled to the first node N1, a second electrode of the second transistor T2 is coupled to a first end of the first diode D1, and a second end of the first diode D1 is coupled to the second node N2.

In the embodiment of the present disclosure, the first end and the second end of a diode refer to an anode end and a cathode end of the diode, respectively.

The case where the first transistor T1 and the second transistor T2 are both P-type transistors, the first power supply terminal is grounded, and the power management integrated circuit 3 provides an initial voltage VGH is taken as an example for illustrative description.

When the digital-to-analog conversion circuit 8 outputs the high-level signal "1", the first transistor T1 is turned off, the control electrode of the second transistor T2 is in a floating state, the voltage VGH can be completely written into a control electrode of the second transistor T2 (i.e., the switch controller 9 provides the first control signal to the transmission branch 4), a gate-source voltage of the second transistor T2 is approximately 0, and the second transistor T2 is turned off, i.e., the transmission branch 4 is in a cutoff state.

When the digital-to-analog conversion circuit 8 outputs the low-level signal "0", the first transistor T1 is conducting/turned on, a current is formed in the first resistor R1 and the second resistor R2, the first resistor R1 and the second resistor R2 implement voltage division, and a voltage (determined by a ratio between resistances of the first resistor R1 and the second resistor R2) loaded on the control electrode of the second transistor T2 is smaller than VGH. A gate-source voltage of the second transistor T2 is less than 0, and the second transistor T2 is conducting/turned on, i.e., the transmission branch 4 is in a conducting state.

Figure 8:
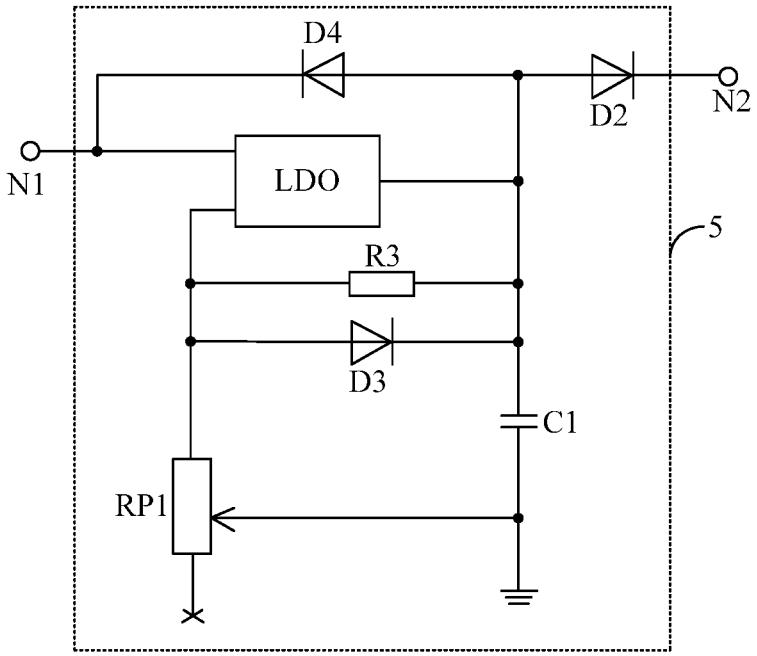
FIG. 8 is a schematic circuit diagram of a voltage reduction branch according to an embodiment of the present disclosure.

FIG. 8 is a schematic circuit diagram of a voltage reduction branch according to an embodiment of the present disclosure. As shown in FIG. 8, in some implementations, the voltage reduction branch 5 includes a low dropout regulator and a second diode D2. A signal input end of the low dropout regulator is coupled to the signal input end of the voltage reduction branch 5, and a signal output end of the low dropout regulator is coupled to a first end of the second diode D2; and a second end of the second diode D2 is coupled to the signal output end of the voltage reduction branch 5.

In some implementations, the low dropout regulator includes a low dropout regulator chip LDO, and a peripheral circuit including a first slide rheostat RP1, a third resistor R3, a third diode D3, a fourth diode D4 and a first capacitor C1.

A control end of the first slide rheostat RP1 is coupled to a second power supply terminal, a first end of the first slide rheostat RP1 is coupled to an output voltage adjusting end of the low dropout regulator chip LDO, and a second end of the first slide rheostat RP1 is floating; a first end of the third resistor R3 is coupled to the output voltage adjusting end of the low dropout regulator chip LDO, and a second end of the third resistor R3 is coupled to the signal output end of the low dropout regulator chip LDO; a first end of the third diode D3 is coupled to the output voltage adjusting end of the low dropout regulator chip LDO, and a second end of the third diode D3 is coupled to the signal output end of the low dropout regulator chip LDO; a first end of the fourth diode D4 is coupled to the signal output end of the low dropout regulator chip LDO, and a second end of the fourth diode D4 is coupled to a signal input end of the low dropout regulator chip LDO; and a first end of the first capacitor C1 is coupled to the signal output end of the low dropout regulator chip LDO, and a second end of the first capacitor C1 is coupled to the second power supply terminal. In the embodiment of the present disclosure, the second power supply terminal is grounded.

A voltage reduction principle of the voltage reduction branch shown in FIG. 8 is as follows: the first node N1 provides an input voltage to the signal input end of the low dropout regulator chip LDO so that the low dropout regulator chip LDO can operate, and a set reference voltage $Vref_0$ is provided between the signal output end and the output voltage adjusting end of the low dropout regulator chip LDO (a voltage difference between the signal output end and the output voltage adjusting end of the LDO is equal to the reference voltage $Vref_0$, $Vref_0$ is determined by a structure of the low dropout regulator chip itself, and generally, $Vref_0$ is set to 1V to 2V, such as 1.25V). Assuming that the first slide rheostat RP1 is connected into the circuit with an effective resistance RP1', and the third resistor R3 has a resistance R3', since the effective resistance of the first slide rheostat RP1 connected into the circuit is connected in series with the third resistor R3, a voltage difference across the third resistor R3 is $Vref_0$, and based on the principle of voltage division in series, it may be calculated that the voltage at the signal output end of the LDO is $Vref_0$*(RP1'+R3')/R3'. It can be seen that, by adjusting the effective resistance RP1' of the first slide rheostat RP1 connected into the circuit, the output voltage at the signal output end of the low dropout regulator chip LDO can be adjusted, that is, a voltage drop (i.e., the voltage difference between the signal output end and the signal input end) of the low dropout regulator can be adjusted. It should be noted that the low dropout regulator chip LDO is a conventional device in the art, and thus, the internal structure and the operating principle thereof are not described in detail here. The third diode D3 and the fourth diode D4 are configured to guarantee unidirectional conduction of the circuit, and the first capacitor C1 is used for noise reduction and filtering of signals output from the signal output end of the low dropout regulator chip LDO.

Figure 9:
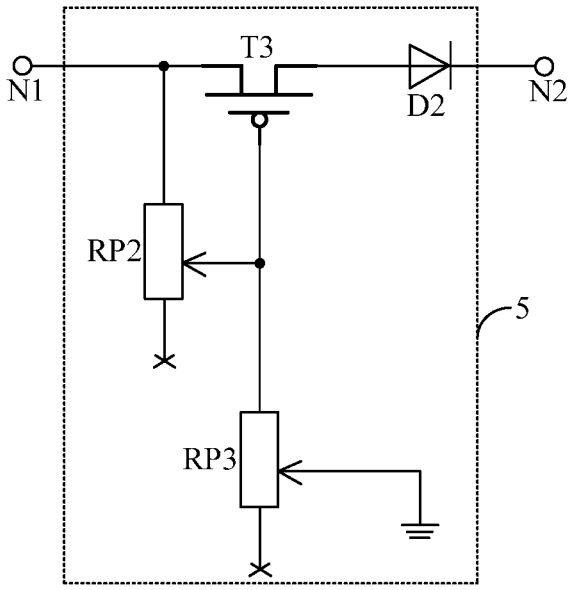
FIG. 9 is another schematic circuit diagram of a voltage reduction branch according to an embodiment of the present disclosure.

FIG. 9 is another schematic circuit diagram of a voltage reduction branch according to an embodiment of the present disclosure. As shown in FIG. 9, in some implementations, the voltage reduction branch 5 includes a third transistor T3, a second slide rheostat RP2, a third slide rheostat RP3 and a second diode D2.

Taking the third transistor T3 being a P-type transistor as an example, a control electrode of the third transistor T3 is coupled to a control end of the second slide rheostat RP2 and a first end of the third slide rheostat RP3, a first electrode of the third transistors T3 is coupled to the signal input end of the voltage reduction branch 5, and a second electrode of the third transistor T3 is coupled to a first end of the second diode D2; a second end of the second diode D2 is coupled to the signal output end of the voltage reduction branch 5; a first end of the second slide rheostat RP2 is coupled to the signal input end of the voltage reduction branch 5, and a second end of the second slide rheostat RP2 is floating; a control end of the third slide rheostat RP3 is coupled to a second power supply terminal, and a second end of the third slide rheostat RP3 is floating.

A voltage reduction principle of the voltage reduction branch shown in FIG. 9 is as follows: assuming that the voltage at the first node N1 is VN1, the second slide rheostat RP2 is connected into the circuit with an effective resistance RP2', and the third slide rheostat RP3 is connected into the circuit with an effective resistance RP3', when the second slide rheostat RP2 and the third slide rheostat RP3 are connected in series for voltage division, the voltage written into the control electrode of the third transistor T3 is VN1*RP3'/(RP2'+RP3'). By adjusting magnitudes of RP2' and RP3', the voltage written into the control electrode of the third transistor T3 can be adjusted, that is, a degree of conduction of the third transistor T3 can be controlled so that a magnitude of voltage drop $\Delta V_{T3}$ of the voltage VGH, which is generated by the third transistor T3, (that is, the output reduced voltage) can be controlled, and in such case, a magnitude of the voltage output from the second electrode of the third transistor T3 is VN1$-\Delta V_{T3}$. It can be seen that by adjusting the voltage drop $\Delta V_{T3}$, the voltage written by the voltage reduction branch 5 into the second node N2 can be controlled.

Figure 10:
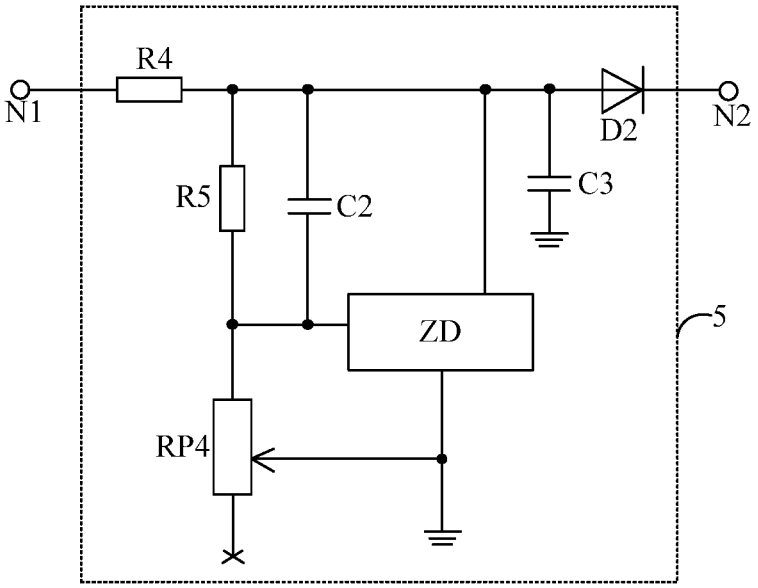
FIG. 10 is yet another schematic circuit diagram of a voltage reduction branch according to an embodiment of the present disclosure.

FIG. 10 is yet another schematic circuit diagram of a voltage reduction branch according to an embodiment of the present disclosure. As shown in FIG. 10, in some implementations, the voltage reduction branch 5 includes a fourth resistor R4, a fifth resistor R5, a Zener diode ZD, a fourth slide rheostat RP4, a second capacitor C2 and a second diode D2.

A first end of the fourth resistor R4 is coupled to the signal input end of the voltage reduction branch 5, and a second end of the fourth resistor R4 is coupled to a first end of the second diode D2; a first end of the fifth resistor R5 is coupled to the first end of the second diode D2, and a second end of the fifth resistor R5 is coupled to a first end of the fourth slide rheostat RP4; a control end of the fourth slide rheostat RP4 is coupled to a second power supply terminal, the first end of the fourth slide rheostat RP4 is coupled to a reference signal supply end of the Zener diode ZD, and a second end of the fourth slide rheostat RP4 is floating; a first electrode of the Zener diode ZD is coupled to the second power supply terminal, and a second electrode of the Zener diode ZD is coupled to the first end of the second diode D2; a first end of the second capacitor C2 is coupled to the second electrode of the Zener diode ZD, and a second end of the second capacitor C2 is coupled to the reference signal supply end of the Zener diode ZD; and a second end of the second diode D2 is coupled to the signal output end of the voltage reduction branch 5.

The first electrode and the second electrode of the Zener diode ZD refer to an anode and a cathode of the Zener diode ZD, respectively.

A voltage reduction principle of the voltage reduction branch shown in FIG. 10 is as follows: the reference signal supply end of the Zener diode ZD may provide a preset reference voltage, which is denoted as $Vref_1$, the fourth slide rheostat RP4 is connected into the circuit with an effective resistance RP4', and the fifth resistor has a resistance R5'. In such case, the current flowing through the fourth slide rheostat RP4 is $Vref_1$/RP4', and the current flowing through the fifth resistor R5 is of the same magnitude as the current flowing through the fourth slide rheostat RP4. Therefore, a voltage difference across the fifth resistor R5 is $Vref_1$*R5'/RP4', and the voltage at the first end of the fifth resistor R5 is $Vref_1$*R5'/RP4'+$Vref_1$. By adjusting a magnitude of RP4', the voltage at the first end of the fifth resistor R5, that is, the voltage written into the first end of the second diode D2, is controlled to control the output reduced voltage. The fourth resistor R4 is configured as a load, and the second capacitor C2 is configured to maintain a stable voltage at the second end of the fifth resistor R5.

In some implementations, the voltage reduction branch 5 further includes a third capacitor C3. A first end of the third capacitor C3 is coupled to the first end of the second diode D2, a second end of the third capacitor C3 is grounded, and the third capacitor C3 is configured for noise reduction and filtering before output.

It should be noted that the specific circuit structures of the voltage reduction branch 5 shown in FIGS. 8 to 10 are merely exemplary implementations according to the embodiment of the present disclosure, and do not configure any limitation to the technical solution of the present disclosure. In the technical solution of the present disclosure, other circuit structures with a voltage reduction function may be adopted, but are not elaborated here one by one.

In some implementations, as shown in FIG. 6, the voltage supply circuit 1 further includes a level conversion circuit 10. The level conversion circuit 10 has a signal input end coupled to the second node N2, and is configured to perform level conversion on a signal at the second node N2, and output the signal to the gate driver circuit 2 to determine a voltage magnitude of a scanning signal. For example, the signal at the second node N2 may be converted into a timer signal, which is used as a scanning signal, through the level conversion circuit 10.

An embodiment of the present disclosure further provides a display driver circuit, including a gate driver circuit and a voltage supply circuit, the voltage supply circuit may adopt the voltage supply circuit as described in the above embodiments, and details thereof are not repeated here.

An embodiment of the present disclosure further provides a display device, including the display driver circuit as described in the above embodiments.

The display device provided in the embodiment of the present disclosure may be an electronic paper, a liquid crystal display panel, a mobile phone, a tablet, a television, a monitor, a laptop, a digital album, a navigator or any other product or component having a display function.

It will be appreciated that the above implementations are merely exemplary implementations for the purpose of illustrating the principle of the present disclosure, and the present disclosure is not limited thereto. It will be apparent to one of ordinary skill in the art that various modifications and variations may be made without departing from the spirit or essence of the present disclosure. Such modifications and variations should be considered as falling into the protection scope of the present disclosure.

What is claimed is:

1. A voltage supply circuit, comprising: a power management integrated circuit, a transmission branch, and a voltage reduction branch, wherein a signal output end of the power management integrated circuit, a signal input end of the transmission branch, and a signal input end of the voltage reduction branch are coupled to a first node; a signal output end of the transmission branch and a signal output end of the voltage reduction branch are coupled to a second node;

the power management integrated circuit is configured to supply an initial voltage to the first node;

the transmission branch is coupled to a control signal terminal, has a conducting state and a cutoff state, and is configured to switch between the conducting state and the cutoff state in response to control of a control signal provided by the control signal terminal, and write the initial voltage at the first node into the second node in the conducting state; and the voltage reduction branch is configured to perform voltage reduction on the initial voltage at the first node to obtain a reduced voltage, and write the reduced voltage into the second node when the transmission branch is in the cutoff state, the voltage supply circuit further comprises:

a state control circuit having a signal output end coupled to the control signal terminal, wherein the state control circuit is configured to provide a first control signal lasting for a preset time length to the control signal terminal every other preset cycle, and provide a second control signal to the control signal terminal after the preset time length expires; and the transmission branch is switched to the cutoff state in response to control of the first control signal, and switched to the conducting state in response to control of the second control signal.

2. The voltage supply circuit according to claim 1, wherein the state control circuit comprises a timer, a digital-to-analog conversion circuit, and a switch controller, the timer is coupled to a signal input end of the digital-to-analog conversion circuit, a signal output end of the digital-to-analog conversion circuit is coupled to a signal input end of the switch controller, and a signal output end of the switch controller is coupled to the control signal terminal;

the timer is configured to time at a start of each preset cycle, send a timing result as a digital signal to the digital-to-analog conversion circuit, and reset the timing result at an end of each preset cycle;

the digital-to-analog conversion circuit is configured to perform digital-to-analog conversion on the received digital signal based on a preset digital-to-analog conversion rule to obtain a corresponding analog signal, and send the analog signal to the switch controller; and the switch controller is configured to output the first control signal or the second control signal matched with the analog signal in response to control of the analog signal.

3. The voltage supply circuit according to claim 2, wherein the switch controller comprises: a first resistor, a second resistor and a first transistor;

a first end of the first resistor is coupled to the first node, and a second end of the first resistor is coupled to a first end of the second resistor;

the first end of the second resistor is coupled to the signal output end of the switch controller, and a second end of the second resistor is coupled to a first electrode of the first transistor; and a control electrode of the first transistor is coupled to the signal input end of the switch controller, and a second electrode of the first transistor is coupled to a first power supply terminal.

4. The voltage supply circuit according to claim 1, wherein the transmission branch comprises a second transistor and a first diode;

a control electrode of the second transistor is coupled to the control signal terminal, a first electrode of the second transistor is coupled to the first node, a second electrode of the second transistor is coupled to a first end of the first diode, and a second end of the first diode is coupled to the second node.

5. The voltage supply circuit according to claim 1, wherein the voltage reduction branch comprises a low dropout regulator and a second diode;

a signal input end of the low dropout regulator is coupled to the signal input end of the voltage reduction branch circuit, and a signal output end of the low dropout regulator is coupled to a first end of the second diode; and a second end of the second diode is coupled to the signal output end of the voltage reduction branch.

6. The voltage supply circuit according to claim 5, wherein the low dropout regulator comprises a low dropout regulator chip, and a peripheral circuit comprising a first slide rheostat, a third resistor, a third diode, a fourth diode and a first capacitor;

a control end of the first slide rheostat is coupled to a second power supply terminal, a first end of the first slide rheostat is coupled to an output voltage adjusting end of the low dropout regulator chip, and a second end of the first slide rheostat is floating;

a first end of the third resistor is coupled to the output voltage adjusting end of the low dropout regulator chip, and a second end of the third resistor is coupled to a signal output end of the low dropout regulator chip;

a first end of the third diode is coupled to the output voltage adjusting end of the low dropout regulator chip, and a second end of the third diode is coupled to the signal output end of the low dropout regulator chip;

a first end of the fourth diode is coupled to the signal output end of the low dropout regulator chip, and a first end of the fourth diode is coupled to a signal input end of the low dropout regulator chip; and a first end of the first capacitor is coupled to the signal output end of the low dropout regulator chip, and a second end of the first capacitor is coupled to the second power supply terminal.

7. The voltage supply circuit according to claim 1, wherein the voltage reduction branch comprises a third transistor, a second slide rheostat, a third slide rheostat and a second diode;

a control electrode of the third transistor is coupled to a control end of the second slide rheostat and a first end of the third slide rheostat, a first electrode of the third transistors is coupled to the signal input end of the voltage reduction branch, and a second electrode of the third transistor is coupled to a first end of the second diode;

a second end of the second diode is coupled to the signal output end of the voltage reduction branch;

a first end of the second slide rheostat is coupled to the signal input end of the voltage reduction branch, and a second end of the second slide rheostat is floating;

a control end of the third slide rheostat is coupled to a second power supply terminal, and a second end of the third slide rheostat is floating; and the second end of the second diode is coupled to the signal output end of the voltage reduction branch.

8. The voltage supply circuit according to claim 1, wherein the voltage reduction branch comprises a fourth resistor, a fifth resistor, a Zener diode, a fourth slide rheostat, a second capacitor and a second diode;

a first end of the fourth resistor is coupled to the signal input end of the voltage reduction branch, and a second end of the fourth resistor is coupled to a first end of the second diode;

a first end of the fifth resistor is coupled to the first end of the second diode, and a second end of the fifth resistor is coupled to a first end of the fourth slide rheostat;

a control end of the fourth slide rheostat is coupled to a second power supply terminal, the first end of the fourth slide rheostat is coupled to a reference signal supply end of the Zener diode, and a second end of the fourth slide rheostat is floating;

a first electrode of the Zener diode is coupled to the second power supply terminal, and a second electrode of the Zener diode is coupled to the first end of the second diode;

a first end of the second capacitor is coupled to the second electrode of the Zener diode, and a second end of the second capacitor is coupled to the reference signal supply end of the Zener diode; and a second end of the second diode is coupled to the signal output end of the voltage reduction branch.

9. The voltage supply circuit according to claim 1, further comprising a level conversion circuit, wherein the level conversion circuit has a signal input end coupled to the second node, and is configured to perform level conversion on a signal at the second node.

10. A display driver circuit, comprising: a gate driver circuit, and a voltage supply circuit, wherein a signal output end of the voltage supply circuit is coupled to an operating voltage input end configured for the gate driver circuit, the voltage supply circuit comprises: a power management integrated circuit, a transmission branch, and a voltage reduction branch, wherein a signal output end of the power management integrated circuit, a signal input end of the transmission branch, and a signal input end of the voltage reduction branch are coupled to a first node; a signal output end of the transmission branch and a signal output end of the voltage reduction branch are coupled to a second node;

the power management integrated circuit is configured to supply an initial voltage to the first node;

the transmission branch is coupled to a control signal terminal, has a conducting state and a cutoff state, and is configured to switch between the conducting state and the cutoff state in response to control of a control signal provided by the control signal terminal, and write the initial voltage at the first node into the second node in the conducting state; and the voltage reduction branch is configured to perform voltage reduction on the initial voltage at the first node to obtain a reduced voltage, and write the reduced voltage into the second node when the transmission branch is in the cutoff state.

11. A display driving method based on the display driver circuit according to claim 10, the display driving method comprising:

providing, by the voltage supply circuit, a first operating voltage to the operating voltage input end configured for the gate driver circuit in a first frame in an inversion adjustment cycle; and providing, by the voltage supply circuit, a second operating voltage to the operating voltage input end configured for the gate driver circuit in another frame except the first frame in the inversion adjustment cycle, wherein the first operating voltage is lower than the second operating voltage.

12. The display driver circuit according to claim 10, further comprising: a state control circuit having a signal output end coupled to the control signal terminal; wherein the state control circuit is configured to provide a first control signal lasting for a preset time length to the control signal terminal every other preset cycle, and provide a second control signal to the control signal terminal after the preset time length expires; and the transmission branch is switched to the cutoff state in response to control of the first control signal, and switched to the conducting state in response to control of the second control signal.

13. The display driver circuit according to claim 12, wherein the state control circuit comprises a timer, a digital-to-analog conversion circuit, and a switch controller, the timer is coupled to a signal input end of the digital-to-analog conversion circuit, a signal output end of the digital-to-analog conversion circuit is coupled to a signal input end of the switch controller, and a signal output end of the switch controller is coupled to the control signal terminal;

the timer is configured to time at a start of each preset cycle, send a timing result as a digital signal to the digital-to-analog conversion circuit, and reset the timing result at an end of each preset cycle;

the digital-to-analog conversion circuit is configured to perform digital-to-analog conversion on the received digital signal based on a preset digital-to-analog conversion rule to obtain a corresponding analog signal, and send the analog signal to the switch controller; and the switch controller is configured to output the first control signal or the second control signal matched with the analog signal in response to control of the analog signal.

14. The display driver circuit according to claim 13, wherein the switch controller comprises: a first resistor, a second resistor and a first transistor;

a first end of the first resistor is coupled to the first node, and a second end of the first resistor is coupled to a first end of the second resistor;

the first end of the second resistor is coupled to the signal output end of the switch controller, and a second end of the second resistor is coupled to a first electrode of the first transistor; and a control electrode of the first transistor is coupled to the signal input end of the switch controller, and a second electrode of the first transistor is coupled to a first power supply terminal.

15. The display driver circuit according to claim 10, wherein the transmission branch comprises a second transistor and a first diode;

a control electrode of the second transistor is coupled to the control signal terminal, a first electrode of the second transistor is coupled to the first node, a second electrode of the second transistor is coupled to a first end of the first diode, and a second end of the first diode is coupled to the second node.

16. The display driver circuit according to claim 10, wherein the voltage reduction branch comprises a low dropout regulator and a second diode;

a signal input end of the low dropout regulator is coupled to the signal input end of the voltage reduction branch circuit, and a signal output end of the low dropout regulator is coupled to a first end of the second diode; and a second end of the second diode is coupled to the signal output end of the voltage reduction branch.

17. The display driver circuit according to claim 16, wherein the low dropout regulator comprises a low dropout regulator chip, and a peripheral circuit comprising a first slide rheostat, a third resistor, a third diode, a fourth diode and a first capacitor;

a control end of the first slide rheostat is coupled to a second power supply terminal, a first end of the first slide rheostat is coupled to an output voltage adjusting end of the low dropout regulator chip, and a second end of the first slide rheostat is floating;

a first end of the third resistor is coupled to the output voltage adjusting end of the low dropout regulator chip, and a second end of the third resistor is coupled to a signal output end of the low dropout regulator chip;

a first end of the third diode is coupled to the output voltage adjusting end of the low dropout regulator chip, and a second end of the third diode is coupled to the signal output end of the low dropout regulator chip;

a first end of the fourth diode is coupled to the signal output end of the low dropout regulator chip, and a first end of the fourth diode is coupled to a signal input end of the low dropout regulator chip; and a first end of the first capacitor is coupled to the signal output end of the low dropout regulator chip, and a second end of the first capacitor is coupled to the second power supply terminal.

18. The display driver circuit according to claim 10, wherein the voltage reduction branch comprises a third transistor, a second slide rheostat, a third slide rheostat and a second diode;

a control electrode of the third transistor is coupled to a control end of the second slide rheostat and a first end of the third slide rheostat, a first electrode of the third transistors is coupled to the signal input end of the voltage reduction branch, and a second electrode of the third transistor is coupled to a first end of the second diode;

a second end of the second diode is coupled to the signal output end of the voltage reduction branch;

a first end of the second slide rheostat is coupled to the signal input end of the voltage reduction branch, and a second end of the second slide rheostat is floating;

a control end of the third slide rheostat is coupled to a second power supply terminal, and a second end of the third slide rheostat is floating; and the second end of the second diode is coupled to the signal output end of the voltage reduction branch.

19. The display driver circuit according to claim 10, wherein the voltage reduction branch comprises a fourth resistor, a fifth resistor, a Zener diode, a fourth slide rheostat, a second capacitor and a second diode;

a first end of the fourth resistor is coupled to the signal input end of the voltage reduction branch, and a second end of the fourth resistor is coupled to a first end of the second diode;

a first end of the fifth resistor is coupled to the first end of the second diode, and a second end of the fifth resistor is coupled to a first end of the fourth slide rheostat;

a control end of the fourth slide rheostat is coupled to a second power supply terminal, the first end of the fourth slide rheostat is coupled to a reference signal supply end of the Zener diode, and a second end of the fourth slide rheostat is floating;

a first electrode of the Zener diode is coupled to the second power supply terminal, and a second electrode of the Zener diode is coupled to the first end of the second diode;

a first end of the second capacitor is coupled to the second electrode of the Zener diode, and a second end of the second capacitor is coupled to the reference signal supply end of the Zener diode; and a second end of the second diode is coupled to the signal output end of the voltage reduction branch.

20. The display driver circuit according to claim 10, further comprising a level conversion circuit, wherein the level conversion circuit has a signal input end coupled to the second node, and is configured to perform level conversion on a signal at the second node.

* * * * *